US008653761B2

(12) United States Patent
Heid

(10) Patent No.: US 8,653,761 B2
(45) **Date of Patent: *Feb. 18, 2014**

(54) CASCADE ACCELERATOR

(75) Inventor: Oliver Heid, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 16 days.

This patent is subject to a terminal disclaimer.

(21) Appl. No.: 13/375,049

(22) PCT Filed: Mar. 26, 2010

(86) PCT No.: PCT/EP2010/054021

§ 371 (c)(1),
(2), (4) Date: Nov. 29, 2011

(87) PCT Pub. No.: WO2010/136235

PCT Pub. Date: Dec. 2, 2010

(65) Prior Publication Data

US 2012/0068632 A1 Mar. 22, 2012

(30) Foreign Application Priority Data

May 29, 2009 (DE) ..... 10 2009 023 305

(51) Int. Cl.
*H01J 23/00* (2006.01)

(52) U.S. Cl.
USPC ..... 315/500; 315/502; 315/505; 315/506

(58) Field of Classification Search
USPC ..... 315/500–506
See application file for complete search history.

(56) References Cited

U.S. PATENT DOCUMENTS

| | | | | |
|---|---|---|---|---|
| 2,887,599 | A | 5/1959 | Trump | 313/74 |
| 4,092,712 | A * | 5/1978 | Harrigill et al. | 363/60 |
| 5,135,704 | A * | 8/1992 | Shefer et al. | 376/108 |
| 5,757,146 | A | 5/1998 | Carder | 315/505 |
| 5,811,944 | A | 9/1998 | Sampayan et al. | 315/505 |
| 5,821,705 | A * | 10/1998 | Caporaso et al. | 315/507 |
| 6,459,766 | B1 * | 10/2002 | Srinivasan-Rao | 378/119 |

(Continued)

FOREIGN PATENT DOCUMENTS

| | | | |
|---|---|---|---|
| EP | 0412896 A1 | 2/1991 | H05H 5/00 |
| JP | 2007518248 A | 7/2007 | H01J 23/00 |

(Continued)

OTHER PUBLICATIONS

International PCT Search Report and Written Opinion, PCT/EP2010/054021, 18 pages, Mailed Oct. 15, 2010.

(Continued)

*Primary Examiner* — Daniel Cavallari
*Assistant Examiner* — Srinivas Sathiraju
(74) *Attorney, Agent, or Firm* — King & Spalding L.L.P.

(57) ABSTRACT

A cascade accelerator (1), with two sets (2, 4) of capacitors (26, 28) which are each connected in series, interconnected by diodes (24, 30) in the form of a Greinacher cascade (20), is to have in a compact construction a particularly high attainable particle energy. Therefore, the cascade accelerator has an acceleration channel (8) which is formed through openings in the electrodes of the capacitors of a set (2), directed to a particle source (6) arranged in the region of the electrode with the highest voltage (12), wherein the electrodes are insulated to each other apart from the acceleration channel (8) with a solid or liquid insulation material (14).

20 Claims, 1 Drawing Sheet

(56) References Cited

U.S. PATENT DOCUMENTS

| | | | | |
|---|---|---|---|---|
| 6,653,642 | B2 * | 11/2003 | Pedersen et al. | 250/492.21 |
| 7,218,500 | B2 * | 5/2007 | Adachi | 361/226 |
| 7,601,042 | B2 * | 10/2009 | Srinivasan-Rao et al. | 445/23 |
| 7,924,121 | B2 * | 4/2011 | Caporaso et al. | 333/236 |
| 7,952,288 | B2 * | 5/2011 | Nakazato | 315/3.5 |
| 7,994,739 | B2 * | 8/2011 | Chen | 315/504 |
| 2007/0145916 | A1 | 6/2007 | Caporaso et al. | 315/505 |
| 2007/0181833 | A1 | 8/2007 | Srinivasan-rao et al. | 250/493.1 |
| 2008/0290297 | A1 | 11/2008 | Blasche et al. | 250/492.3 |
| 2012/0068632 | A1 | 3/2012 | Heid | 315/500 |
| 2012/0313554 | A1 * | 12/2012 | Heid | 315/503 |
| 2012/0313556 | A1 * | 12/2012 | Heid | 315/506 |
| 2012/0319624 | A1 * | 12/2012 | Heid et al. | 315/506 |

FOREIGN PATENT DOCUMENTS

| | | | | |
|---|---|---|---|---|
| JP | 2008503037 | A | 1/2008 | A61N 5/10 |
| WO | 2007/120211 | A2 | 10/2007 | |
| WO | 2008/051358 | A1 | 5/2008 | H05H 7/02 |
| WO | 2010/136235 | A1 | 12/2010 | H05H 5/06 |

OTHER PUBLICATIONS

Bellar, M., et al., "Analysis of the Dynamic and Steady-State Performance of Cockcroft-Walton Cascade Rectifiers", IEEE Transactions on Power Electronics; vol. 7, No. 3; pp. 526-534, Jul. 1992.

Boscolo, I., et al., "A Cockcroft-Walton for FELTRON: The New μ-Wave Source for TeV Colliders", IEEE Transactions on Nuclear Science, vol. 39, No. 2; pp. 308-314, Apr. 1, 1992.

Boscolo, I., et al., "FELTRON: a High-Power Microwave Power Source for High-Gradient Linear Colliders", Nuclear Instruments & Methods in Physics Research, vol. A309, No. 3; pp. 585-593, Nov. 15, 1991.

Boscolo, I, et al., "Powerful High-Voltage Generators for FELTRON, the Electrostatic-Accelerator FEL Amplifier for TeV Colliders", Nuclear Instruments & Methods in Physics Research, vol. A318, Nos. 1/3; pp. 465-471, Jul. 1, 1992.

Bouwers, D., "Some New Principles in the Design of X-Ray Apparatus", Philips X-Ray Research Laboratory; Radiology; pp. 163-173, Sep. 25, 1933.

Brugler, J.S., "Theoretical Performance of Voltage Multiplier Circuits", IEEE Jourcan of Solid-State Circuits; pp. 132-135, Jun. 1971.

Cockcroft, J.D., et al., Experiments with High Velocity Positive Ions-I. Further Developments in the Method of Obtaining High Velocity Positive Ions; Proc. Roy. Soc., vol. 129; pp. 619-630, Jun. 1932.

Everhart E., et al., "The Cockcroft-Walton Voltage Multiplying Circuit", The Review of Scientific Instruments, vol. 24, No. 3; pp. 221-226, Mar. 1953.

Greinacher, H., "Erzeugung einer Gleichspannung vom Vielfachen Betrage Einer Wechselspannung ohne Transformator", Zeitschrift Fur Physik; Schweiz Elektrotechnischer Verein; bulletin No. 3; pp. 59-66, Mar. 1920.

Greinacher, H., "Über eine Methode, Wechseistrom mittels elektrischer Ventile und Kondensatoren in Hochgespannien Gleichstrom umzuwandeln", Zeitschrift fürPhysik; vol. 4; pp. 195-205, Jan. 1921.

Kanareykin, A. et al., "Developments on a Diamond-Based Cylindrical Dielectric Accelerating Structure", Linear Colliders, Lepton Accelerators and New Acceleration Techniques; WEPLS039, Proceedings of EPAC 2006; pp. 2460-2462, 2006.

Lin, P.M. et al., "Topological Generation and Analysis of Voltage Multiplier Circuits", IEEE Transactions on Circuits and Systems, vol. CAS-24, No. 10; pp. 517-530, Oct. 1977.

Malesani, L., "Theoretical Performance of the Capacitor-Diode Voltage Multiplier Fed by a Current Source", IEEE Transactions on Power Electronics; vol. 8, No. 2; pp. 147-155, Apr. 1993.

Schenkel, M., "Eine Neue Schaltung fur die Erzeugung hober Fleichspannungen", Elektrotechnische Zeitschrift; pp. 193-200, 1919.

Schumann, W.O., "Fortschritte der Hochspannungstecknik", Band 1, Akademische Verlagsgesellschaft Becker & Erler Kom.-Ges., Liepzig; pp. 193-200, 1944.

Vanoni, E., "La Progettazionne dei Circuiti Moltiplicatori ad Altissima Tensione", L'Elettrotecnica, vol. XXV, No. 21; pp. 766-771, Nov. 10, 1938.

Weiner, M., "Analysis of Crockcroft-Walton Voltage Multipliers with an Arbitrary Number of Stages", The Review of Scientific Instruments, vol. 40, No. 2; pp. 330-333, Feb. 1969.

Zhang, H., et al., "Efficient Compensation Method of Reducing Ripple of Cockcroft-Walton Generator in an Utrahigh-Voltage Electron Microscope", American Institute of Physics, Rev. Sci. Instrum. 65 (10); pp. 3194-3198, Oct. 1994.

Zhang, H., et al., "Fundamental Harmonic of Ripple in Symmetrical Cockcroft-Walton Cascade Rectifying Circuit", American Institute of Physics, Rev. Sci. Instrum. 67 (9); pp. 3336-3337, Sep. 1996.

Zhang H., et al., "A Numerical Analysis Approach to Cockcroft-Walton Circuit in Electron Microscope", J. Electron Microsc. vol. 43, No. 1; pp. 25-31, 1994.

Zhang H., et al., "Transient Analysis of Cockcroft-Walton Cascade Rectifier Circuit After Load Short-Circuit", Int. J. Electronics, vol. 78, No. 5; pp. 995-1005, 1995.

Japanese Office Action, Application No. 2012-512266, 4 pages, Dec. 4, 2012.

* cited by examiner

CASCADE ACCELERATOR

CROSS-REFERENCE TO RELATED APPLICATIONS

This application is a U.S. National Stage Application of International Application No. PCT/EP2010/054021 filed Mar. 26, 2010, which designates the United States of America, and claims priority to German Application No. 10 2009 023 305.9 filed May 29, 2009. The contents of which are hereby incorporated by reference in their entirety.

TECHNICAL FIELD

The invention relates to a cascade accelerator which has two sets of respectively series-connected capacitors connected up via diodes in the manner of a Greinacher cascade. It further relates to a beam therapy device having such a cascade accelerator.

BACKGROUND

Ionizing radiation is used in medical beam therapy in order to cure diseases or to delay their progress. It is chiefly gamma radiation, X-radiation and electrons that are used as ionizing, high energy beams.

In order to produce an electron beam either for direct therapeutic use or for the production of an X-radiation, it is customary to make use of particle accelerators. In particle accelerators, charged particles are brought by electric fields to high speeds and thus high kinetic energies, the electric fields resulting in the case of some accelerator types from electromagnetic induction in variable magnetic fields. In this case, the particles require a kinetic energy that corresponds to a multiple of their natural rest energy.

In the case of the particle accelerators, a distinction is made between particle accelerators with cyclic acceleration, such as the betatron or cyclotron, for example, and those with rectilinear acceleration. The latter enable a more compact design and also comprise so-called cascade accelerators (also Cockcroft-Walton accelerators), in the case of which a Greinacher circuit that is multiply connected in series (cascaded) can be used to produce a high DC voltage, and thus a strong electric field, by multiplication and rectification of an AC voltage.

The mode of operation of the Greinacher circuit is based on an arrangement of diodes and capacitors. The negative half wave of an AC voltage source charges a first capacitor via a first diode to the voltage of the AC voltage source. In the case of the positive half wave following thereupon, the voltage of the first capacitor is then added to the voltage of the AC voltage source so that a second capacitor is now charged via a second diode to double the output voltage of the AC voltage source. A voltage multiplier is thus obtained by multiple cascading in the manner of a Greinacher cascade. The respectively first capacitors in this case form a first set of capacitors, connected directly in series, of the cascade, while the respectively second capacitors form a corresponding second set. The diodes form the cross connection between the sets.

Comparatively high particle energies in the region of mega-electron volts can be achieved in such a cascade accelerator. However, in this case there is the risk of electric flashovers (air breakdown voltage: 3 kV/mm), particularly with cascade accelerators set up under normal atmospheric pressure, as a result of which the maximum particle energy is undesirably limited.

SUMMARY

According to various embodiments, a cascade accelerator that has a particularly high achievable particle energy in conjunction with a compact design can be specified.

According to an embodiment, a cascade accelerator may have two sets of respectively series-connected capacitors connected up via diodes in the manner of a Greinacher cascade, and an acceleration channel formed by openings in the electrodes of the capacitors of a set and directed at a particle source arranged in the region of the electrode with the highest voltage, the electrodes being insulated from one another, except for the acceleration channel, by a solid or liquid insulating material.

According to a further embodiment, a plurality of electrodes can be designed as hollow ellipsoidal segments arranged concentrically around the particle source in a fashion separated from one another. According to a further embodiment, the respective hollow ellipsoidal segment can be a hollow half ellipsoid, and the acceleration channel can be guided through the vertex of the hollow half ellipsoid. According to a further embodiment, the respective diode can be arranged in the region of a great circle of the respective hollow half ellipsoid. According to a further embodiment, a plurality of electrodes can be spaced apart equidistantly from one another. According to a further embodiment, the particle source can be a cold cathode. According to a further embodiment, the acceleration channel may comprises a cylindrical wall that is coated with diamond-like carbon and/or oxidized diamond.

According to another embodiment, a beam therapy device may have a cascade accelerator as described above.

BRIEF DESCRIPTION OF THE DRAWINGS

An exemplary embodiment is explained in more detail with the aid of a drawing, in which.

Identical parts are provided in the two figures with the same reference symbols.

DETAILED DESCRIPTION

Figure 1:
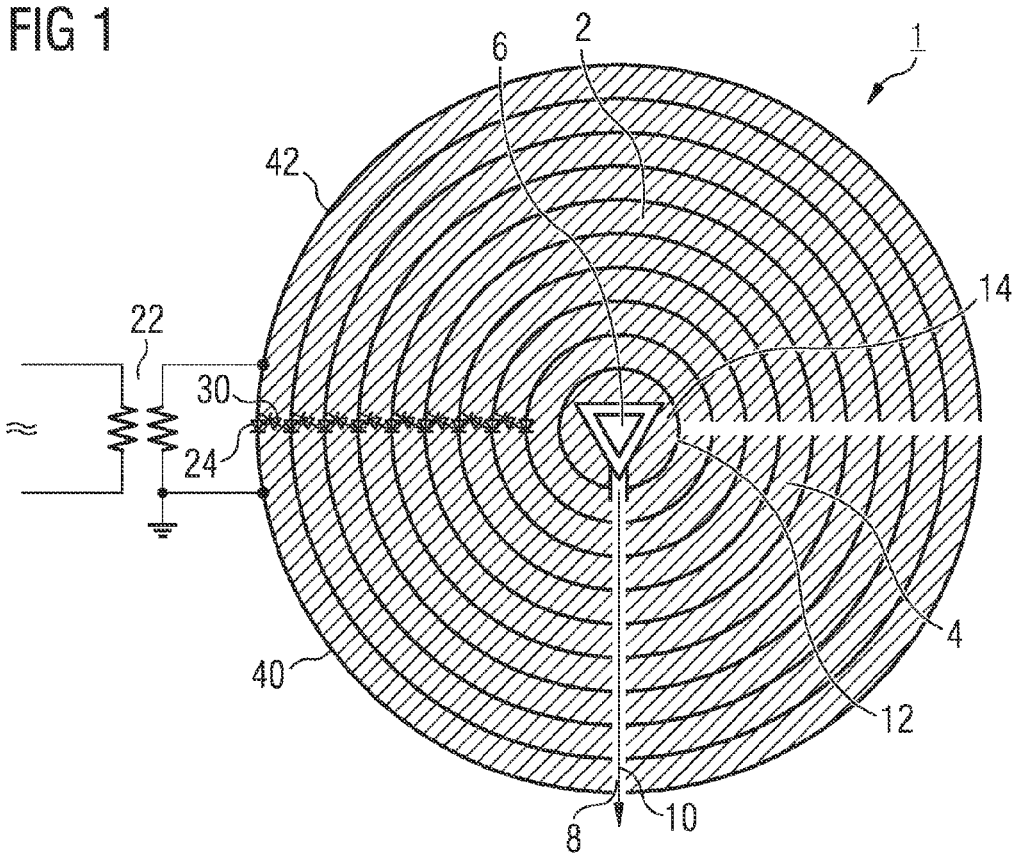
FIG. 1 shows a schematic illustration of a section through a cascade accelerator.

According to various embodiments, a cascade accelerator may comprise an acceleration channel formed by openings in the electrodes of the capacitors of a set and directed at a particle source arranged in the region of the electrode with the highest voltage, the electrodes of the capacitors being insulated from one another, except for the acceleration channel, by a solid or liquid insulating material.

According to various embodiments, the energy of the generated particle beam of the cascade accelerator could be increased by increasing the acceleration voltage. In order to minimize the risk of electric flashover resulting therefrom, the spacing of the individual capacitor plates of the cascade accelerator could be increased. However, this would contradict a compact design, something which is desired precisely, for the ability of use in the field of medicine. In order to enable the acceleration voltage to be increased in conjunction with a compact design, the capacitors therefore should be protected in some other way against electric flashovers. To this end, appropriate liquid or solid insulators that enable reliable insulation of the capacitor plates should be used. This can be achieved by filling up the interspaces of the electrodes with a solid or liquid insulating material except for the acceleration channel.

The high voltages produced in a cascade accelerator should be protected against electric breakdown by an appropriate configuration of the geometry in addition to an appropriate insulation thickness. Consequently, the production of voltage should be integrated with the particle accelerator, and the components having particularly high voltage should be accommodated within the smallest possible volume. Since the maximum electric field strength is proportional to the curvature of the electrodes, a spherical or ellipsoidal geometry is of particular advantage. In particular, a spherical geometry signifies a particularly small volume with regard to the maximum possible electric field strength inside the insulator, and therefore also a particularly small mass. However, in specific designs a deformation toward an ellipsoid may be desired. Consequently, it is advantageous to design a plurality of electrodes as concentric hollow ellipsoidal segments arranged around the particle source in a fashion separated from one another.

A particularly simple design that combines the advantages of an ellipsoidal geometry with the simple production of voltage inside a Greinacher cascade is possible by respectively having hollow half ellipsoids as the electrodes designed as hollow ellipsoid segments, that is to say by arranging for a separation at the equator of the respective hollow ellipsoid so that the multiple layers of hollow half ellipsoids thus produced form the two sets of capacitors that are required for the Greinacher cascade. The acceleration channel is then advantageously guided through the vertex of the respective hollow half ellipsoid, a particularly simple geometry thereby being achieved.

In a further configuration, the respective diodes are arranged in the region of a great circle of the respective hollow half ellipsoid. If, specifically, the hollow half ellipsoids respectively form the two sets of capacitors respectively connected in series, the diodes respectively connect hollow half ellipsoids on alternating hemispheres. The diodes can then be arranged inside an equatorial section for the purpose of a particularly simple design.

In order to attain a particularly high stability of the cascade accelerator against breakdowns, a uniform voltage gradient should be provided along the acceleration path, that is to say between the individual electrodes of the Greinacher cascade. This can be achieved by a plurality of electrodes being spaced apart equidistantly from one another. Since the electrodes of each set have a linear voltage rise, a virtually linear rise in the voltage results thereby along the acceleration channel.

In a further configuration, the particle source is a cold cathode. Electrodes of a cold cathode are unheated and also remain so cold in operation that no thermionic emission takes place at them. A particularly simple design of the cascade accelerator is enabled thereby.

The acceleration channel permits the particle current to be extracted from the cascade accelerator. The acceleration channel should comprise a cylindrical wall that is coated with diamond-like carbon and/or oxidized diamond in order for the acceleration channel also to withstand the tangential electric fields without breakdown. These materials are capable of withstanding these comparatively high voltages.

Such a cascade accelerator is advantageously used in a beam therapy device.

The advantages attained by the various embodiments consist, in particular, in that it is possible in the case of a cascade accelerator based on a Greinacher cascade to produce a particularly high acceleration voltage for accelerating charged particles by embedding the particle source and/or electrodes in a solid or liquid insulating material. Given a design of the electrodes using a spherical or ellipsoid geometry, a particularly compact design is possible, moreover, and the two capacitor sets of the Greinacher circuit are additionally used as concentric potential equilibration electrodes for the electric field distribution around the particle source and high voltage electrode. Such a cascade accelerator enables a particularly high voltage in conjunction with a particularly compact design as is required, in particular, in medical applications.

The cascade generator 1 according to FIG. 1 has a first set 2 and a second set 4 of hollow hemispherical electrodes. These are arranged concentrically around a particle source 6.

Guided through the second set of electrodes 4 is an acceleration channel 8 that is directed at the particle source 6 and permits an extraction of the particle current 10 that emanates from the particle source 6 and experiences a high acceleration voltage from the hollow spherical high voltage electrode 12.

In order to prevent breakdown of the high voltage of the high voltage electrode 12 on the particle source 6 in the interior, the particle source 6 can be completely embedded in a solid or liquid insulating material 14 so that the space between the high voltage electrode 12 and particle source 6 is filled up with the insulating material 14 apart from the acceleration channel 8. It is thereby possible to apply particularly high voltages to the high voltage electrode 12, something which results in a particularly high particle energy. In addition, the electrodes on the capacitor plates of the electrodes can be insulated from one another essentially apart from the acceleration channel 8 by the solid or liquid insulating material 14.

Figure 2:
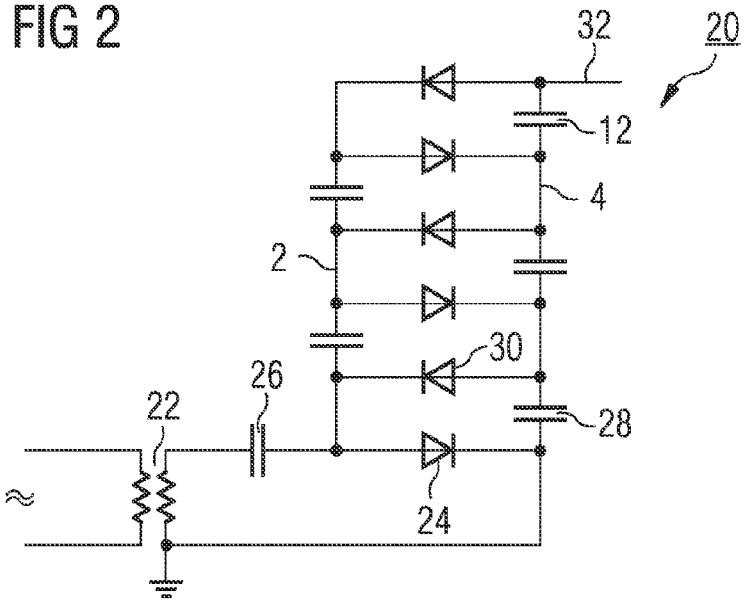
FIG. 2 shows a schematic illustration of a Greinacher circuit.

The high voltage on the high voltage electrode 12 is produced by means of a Greinacher cascade 20 that is illustrated as a circuit diagram in FIG. 2. An AC voltage U is applied at the input 22. The first half wave charges the capacitor 26 to the voltage U via the diode 24. In the case of the half wave of the AC voltage following thereupon, from the voltage U of the capacitor 26 is added to the voltage U at the input 22 so that the capacitor 28 is now charged to the voltage 2U via the diode 30.

This process is repeated in the diodes and capacitors following on thereupon, so that the voltage 6U is attained in total at the output 32 in the circuit illustrated in FIG. 2. FIG. 2 also shows clearly how the first set 2 of capacitors and the second set 4 of capacitors are respectively formed by the circuit illustrated.

The electrodes of two capacitors, respectively interconnected in FIG. 2, are now concentrically designed in the cascade accelerator 1 according to FIG. 1 respectively as a hollow hemispherical shell. In this case, the voltage U of the voltage source 22 is respectively applied to the outermost shells 40, 42. The diodes for forming the circuit are arranged in the region of the great circle of the respective hollow hemisphere, that is to say in the equatorial section of the respective hollow spheres.

A spherical capacitor with an inner radius $r_0$ and outer radius $r_1$ has the capacitance of $$C = 4\pi\varepsilon\frac{r_0 r_1}{r_1 - r_0}.$$

The field strength for radius r is then $$E = \frac{r_0 r_1 U}{(r_1 - r_0) r^2}.$$

This field strength is quadratically dependent on the radius and therefore increases sharply toward the inner electrode.

Owing to the fact that the electrodes of the capacitors of the Greinacher cascade 20 are inserted in the cascade accelerator 1 as intermediate electrodes at a clearly defined potential, the field strength distribution is linearly equalized over the radius, since for thin-walled hollow spheres the electric field strength is approximately equal to the flat case of $$E = \frac{U}{(r_1 - r_0)}$$

with a minimum maximum field strength.

A particularly high acceleration voltage is achieved in a cascade accelerator 1 by the additional use of the two capacitor sets 2, 4 of a Greinacher cascade 20 as concentric potential equilibration electrodes for the electric field distribution in a high voltage electrode 12, essentially completely encapsulated in a solid or liquid insulating material 14. At the same time, the design is very compact, and this enables flexible application, particularly in beam therapy.

LIST OF REFERENCE SYMBOLS

1 Cascade generator
2 First set
4 Second set
6 Particle source
8 Acceleration channel
10 Particle current
12 High voltage electrode
14 Insulating material
20 Greinacher cascade
22 Voltage source
24 Diode
26, 28 Capacitor
30 Diode
32 Output
40, 42 Outermost shells
$r_0$ Inner radius of a spherical capacitor
$r_1$ Outer radius of a spherical capacitor
U Voltage

What is claimed is:

1. A cascade accelerator comprising two sets of respectively series-connected capacitors connected up via diodes in the manner of a Greinacher cascade, and an acceleration channel formed by openings in the electrodes of the capacitors of a set and directed at a particle source arranged in the region of the electrode with the highest voltage, the electrodes being insulated from one another, except for the acceleration channel, by a solid or liquid insulating material.

2. The cascade accelerator according to claim 1, wherein a plurality of electrodes are designed as hollow ellipsoidal segments arranged concentrically around the particle source in a fashion separated from one another.

3. The cascade accelerator according to claim 2, wherein the respective hollow ellipsoidal segment is a hollow half ellipsoid, and the acceleration channel is guided through the vertex of the hollow half ellipsoid.

4. The cascade accelerator according to claim 3, wherein the respective diode is arranged in the region of a great circle of the respective hollow half ellipsoid.

5. The cascade accelerator according to claim 1, wherein a plurality of electrodes are spaced apart equidistantly from one another.

6. The cascade accelerator according to claim 1, wherein the particle source is a cold cathode.

7. The cascade accelerator according to claim 1, wherein the acceleration channel comprises a cylindrical wall that is coated with at least one of diamond-like carbon and oxidized diamond.

8. A beam therapy device having a cascade accelerator comprising two sets of respectively series-connected capacitors connected up via diodes in the manner of a Greinacher cascade, and an acceleration channel formed by openings in the electrodes of the capacitors of a set and directed at a particle source arranged in the region of the electrode with the highest voltage, the electrodes being insulated from one another, except for the acceleration channel, by a solid or liquid insulating material.

9. The beam therapy device according to claim 8, wherein a plurality of electrodes are designed as hollow ellipsoidal segments arranged concentrically around the particle source in a fashion separated from one another.

10. The beam therapy device according to claim 9, wherein the respective hollow ellipsoidal segment is a hollow half ellipsoid, and the acceleration channel is guided through the vertex of the hollow half ellipsoid.

11. The beam therapy device according to claim 10, wherein the respective diode is arranged in the region of a great circle of the respective hollow half ellipsoid.

12. The beam therapy device according to claim 8, wherein a plurality of electrodes are spaced apart equidistantly from one another.

13. The beam therapy device according to claim 8, wherein the particle source is a cold cathode.

14. The beam therapy device according to claim 8, wherein the acceleration channel comprises a cylindrical wall that is coated with at least one of diamond-like carbon and oxidized diamond.

15. A method for providing ionizing radiation comprising:

connecting two sets of respectively series-connected capacitors via diodes in the manner of a Greinacher cascade, and forming an acceleration channel by openings in the electrodes of the capacitors of a set and directed at a particle source arranged in the region of the electrode with the highest voltage, wherein the electrodes being insulated from one another, except for the acceleration channel, by a solid or liquid insulating material.

16. The method according to claim 15, further comprising arranging a plurality of electrodes designed as hollow ellipsoidal segments concentrically around the particle source in a fashion separated from one another.

17. The method according to claim 16, wherein the respective hollow ellipsoidal segment is a hollow half ellipsoid, and the acceleration channel is guided through the vertex of the hollow half ellipsoid.

18. The method according to claim 17, wherein the respective diode is arranged in the region of a great circle of the respective hollow half ellipsoid.

19. The method according to claim 15, wherein a plurality of electrodes are spaced apart equidistantly from one another.

20. The method according to claim 15, wherein the acceleration channel comprises a cylindrical wall that is coated with at least one of diamond-like carbon and oxidized diamond.

* * * * *